US006826881B2

(12) United States Patent
McGregor

(10) Patent No.: US 6,826,881 B2
(45) Date of Patent: Dec. 7, 2004

(54) MIRROR DOOR AND DOOR MOLDING WITH COMPO FRAME DESIGN

(75) Inventor: Jean T. McGregor, Waxhaw, NC (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 10/350,324

(22) Filed: Jan. 24, 2003

(65) Prior Publication Data

US 2003/0159386 A1 Aug. 28, 2003

Related U.S. Application Data

(60) Provisional application No. 60/353,989, filed on Feb. 5, 2002.

(51) Int. Cl.[7] ..... E04F 19/00

(52) U.S. Cl. ..... 52/312; 52/656.2; 52/211; 52/204.53; 264/254; 264/267

(58) Field of Search ..... 52/311.1, 312, 52/717.01, 656.2, 656.7, 211, 204.53, 656.4; 49/504; 264/250, 254, 267, 268

(56) References Cited

U.S. PATENT DOCUMENTS

| | | | | | |
|---|---|---|---|---|---|
| 63,893 | A | * | 4/1867 | Holmes | 52/312 |
| 240,916 | A | * | 5/1881 | Maxwell | 52/312 |
| 303,356 | A | * | 8/1884 | Beck | 52/312 |
| 352,360 | A | * | 11/1886 | Schram et al. | 52/312 |
| 368,245 | A | * | 8/1887 | Schmacher | 52/312 |
| 351,116 | A | * | 6/1900 | Mankey | 52/312 |
| 966,372 | A | | 8/1910 | Weiss | |
| 1,988,236 | A | | 1/1935 | Chatfield | |
| 4,706,431 | A | | 11/1987 | Corvese | |
| 4,898,706 | A | | 2/1990 | Yabe et al. | |
| 5,095,675 | A | | 3/1992 | Audia | |
| 5,250,321 | A | | 10/1993 | Andersson et al. | |
| 5,444,956 | A | * | 8/1995 | Searer et al. | 52/312 |
| 5,508,103 | A | | 4/1996 | Cope | |
| 5,681,652 | A | | 10/1997 | Cope | |
| 5,918,434 | A | * | 7/1999 | Ballantyne et al. | 52/311.1 |
| 6,066,680 | A | | 5/2000 | Cope | |

* cited by examiner

*Primary Examiner*—Peter M. Cuomo
*Assistant Examiner*—Joseph Edell
(74) *Attorney, Agent, or Firm*—Pillsbury Winthrop LLP

(57) ABSTRACT

A decorative door molding includes an elongated panel having a contoured top surface. The contoured top surface has at least a first and second raised portion extending along the top surface. The first and second raised portions have a first and a second predetermined height and form a recessed portion. A raised decorative portion is formed on at least a portion of the recessed portion and has a height that is less than the smaller of the first and second predetermined heights. A decorative door is also provided that includes a generally rectangular frame and an interior panel connected to the frame. The frame includes at least one panel having the contoured surface. The contoured surface has first and second raised portions having first and second predetermined heights. The first and second raised portions form a recessed portion. A raised decorative portion is formed on at least a portion of the recessed portion and has a height that is less than the smaller of the first and second predetermined heights. Another decorative door is provided that includes a decorative portion including a composition material configured to provide an ornamental design on the frame.

13 Claims, 10 Drawing Sheets

MIRROR DOOR AND DOOR MOLDING WITH COMPO FRAME DESIGN

This application claims the benefit of U.S. Provisional Application No. 60/353,989, filed Feb. 5, 2002.

BACKGROUND OF THE INVENTION

1. Field of the Invention

The present invention relates to doors and more particularly to decorative doors and decorative moldings used as frames for such decorative doors.

2. Description of Related Art

Generally, doors are framed by a door molding positioned in a doorway, such as an interior doorway including a doorway between rooms, a closet doorway, or a patio door opening, of a residential or commercial structure.

As is typical for most doors or door moldings, doors and door moldings can include very fine ornate detail or intricate patterns, which typically are hand carved from wood and expensive. There is a need to develop a relatively inexpensive alternative to these labor intensive carvings. Compo material has been used in connection with the production of decorative frames for pictures, paintings and mirrors. A compo material is a generally inexpensive material that is typically a paste or other moldable material that is applied to a base substrate. The compo material can be rolled with a patterned wheel or molded to create a decorative design. The compo material, however, is relatively brittle and can be chipped or cracked if contacted with sufficient force. As such, the use of compo material alone has traditionally been deemed unsuitable for use on doors and door moldings.

Doors and door moldings can be exposed to contact from various sources, such as boots, toys, tools or vacuum cleaners, for example. This contact can damage or destroy the decorative design on the doors or the door moldings, thus requiring repair or replacement. As such, there is a disadvantage to applying intricate patterns or fine ornate details on these types moldings for aesthetic appeal using a compo material. The contact may damage or remove the intricate patterns or the fine ornate details. There is a need for a low cost decorative molding having decorative portions that may be protected from the above-described contact to avoid chipping and other damage.

OBJECTS OF THE INVENTION

It is one aspect of the invention to provide a decorative door having a construction that protects a decorative portion of the door from contact.

It is another aspect of the invention to provide a decorative molding having a construction that protects a decorative portion of the molding from contact.

It is yet another aspect of the invention to provide a decorative molding and a decorative door associated with the decorative molding, wherein each of the decorative molding and the decorative door has a construction that protects a respective decorative portion from contact.

SUMMARY OF THE INVENTION

In response to the foregoing challenges, applicant has developed a decorative door comprising a frame having a top panel, a bottom panel and a pair of side panels and an interior panel connected to each of the top panel, the bottom panel and the pair of side panels. The top panel is connected to each of the side panels and the bottom panel is connected to the side panels to form a generally rectangular frame. At least one of the top panel, the bottom panel and the pair of side panels has a contoured top surface having a length, at least a first raised portion extending along the length of the contoured top surface and a second raised portion extending along the length of the contoured top surface in a generally parallel and spaced relation to the first raised portion. The first raised portion and the second raised portion have a first predetermined height and a second predetermined height. The first and second raised portions form a recessed portion. A raised decorative portion is formed on at least a portion of the recessed portion, wherein the raised decorative portion has a height that is less than the smaller of the first and second predetermined heights.

Applicant has also developed a decorative molding comprising an elongated panel having a contoured top surface. The contoured top surface has at least a first raised portion extending along the top surface in a longitudinal direction and a second raised portion extending along the top surface in a generally parallel and spaced relation to the first raised portion. The first raised portion and the second raised portion have a first predetermined height and a second predetermined height. The first and second raised portions form a recessed portion and a raised decorative portion formed on at least a portion of the recessed portion. The raised decorative portion has a height that is less than the smaller of the first and second predetermined heights. The molding may be used to trim out a door or room.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

Figure 1:
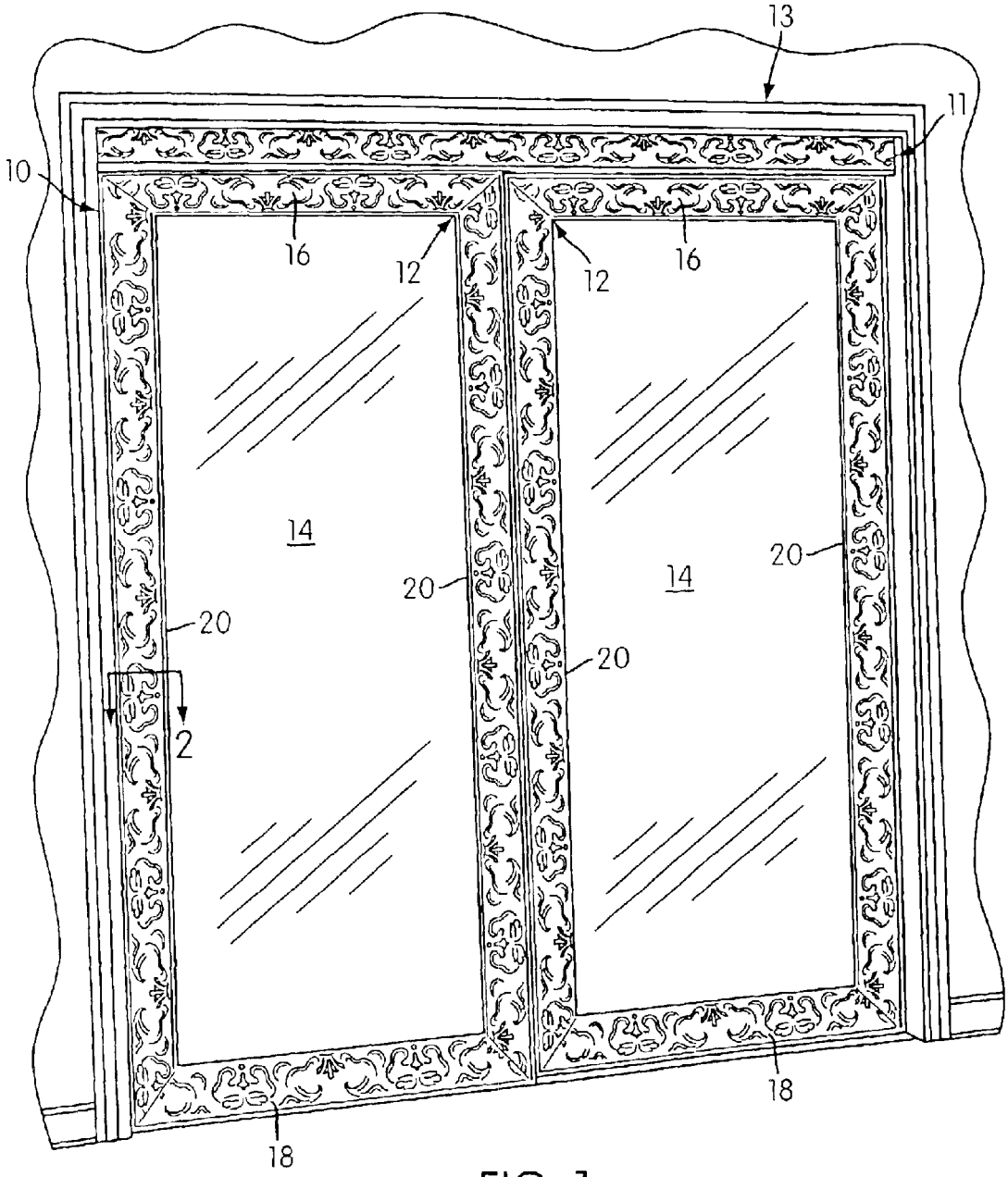
FIG. 1 is a perspective view of a decorative door in accordance with the principles of the present invention.

FIG. 1 shows a double door having two decorative doors 10, each decorative door 10 comprising a frame 12 and an interior panel 14. The interior panel 14 is secured to the door 10 by the frame 12. The doors 10 can be at least partially surrounded by a decorative molding 11, and the doors 10 and the molding 11 can be positioned within a doorway 13. The doors 10 and the molding 11 may also be positioned in different areas of a residential or commercial structure, such as, in an interior doorway, a patio door opening, a doorway between rooms, or a closet doorway, for example.

The door frame 12, having a generally rectangular configuration, includes a top panel 16, a bottom panel 18 and a pair of side panels 20. The top panel 16 is connected to each of the side panels 20 and the bottom panel 18 is connected to each of the side panels 20 to form the generally rectangular configuration. A panel is described below as being any of the top panel 16, the bottom panel 18, the side panels 20 or any other part of a door or door molding that can be positioned adjacent a doorway. Furthermore, a panel may include elongated panels that may be used for moldings. These panels can be formed can be formed of various materials and formed into various shapes and is not limited to a flat, rectangular object. For example, each of the top panel 16, the bottom panel 18 and the side panels 20 can be made from wood, wood polymer composite, fiberglass, metal or any other suitable material that can be used to make an entire door or any part of a door.

Any combination of the top panel 16, the bottom panel 18 and the side panels 20, can be connected to form different frame configurations. Alternatively, the panels can be arched, for example, to form an arch-topped door or other door or frame configuration.

Figure 2:
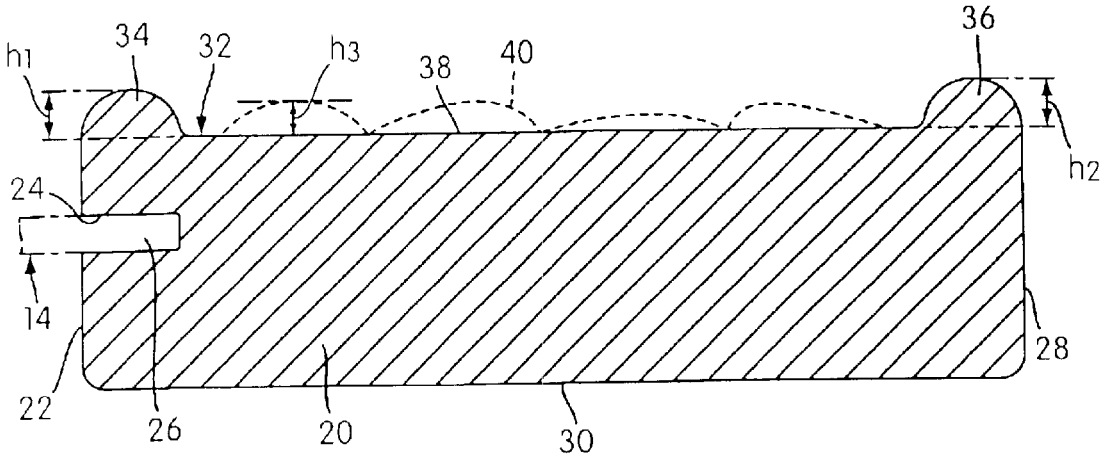
FIG. 2 is a cross sectional view taken along the line 2—2 in FIG. 1 showing a frame panel having a top contoured surface.

Each of the top panel 16, the bottom panel 18 and the side panels 20 includes a peripheral inner surface 22 having a groove 24 formed therein (FIG. 2). The groove 24 is configured to receive at least an outer portion 26 of the interior panel 14. The outer portion 26 is securely held in the groove 24 without bonding agents or adhesives, however, such bonding agents or adhesives may be provided to further secure the outer portion 26 in the groove 24.

Each of the top panel 16, the bottom panel 18 and the side panels 20 also includes a peripheral outer surface 28 that is opposite and substantially parallel to the peripheral inner surface 22 and perpendicular to an inside surface surface 30. The inside surface 30 is substantially flat and is configured to be placed parallel to a substantially flat wall or doorway.

At least one of the top panel 16, the bottom panel 18 and the side panels 20 includes a contoured top surface 32 having a cross-sectional length. FIG. 2 shows one of the side panels 20 in cross section having the contoured top surface 32, but FIG. 2 is representative of a cross section that may exist in any one of the top panel 16, the bottom panel 18 or the other side panel 20 because these panels have substantially similar construction.

A first raised portion 34 extends the length of the contoured top surface 32 and a second raised portion 36 extends the length of the contoured top surface 32 in a generally parallel and spaced relation to the first raised portion 34. As illustrated in FIG. 2, the first raised portion 34 extends from the peripheral outer surface 28 and the second raised portion 36 extends from the peripheral inner surface 22. The first and second raised portions 34, 36 have a predetermined height, as represented by h1 and h2, respectively. Although the height h1 of the first raised portion 34 is shown being substantially equal to the height h2 of the second raised portion 36, the heights h1, h2 do not have to be equal.

The first and second raised portions 34, 36 can be integrally formed with the at least one of the top panel 16, the bottom panel 18 and the side panels 20 or may be attached separately thereto, during processing for example, to form a recessed portion 38. The recessed portion 38 extends between the first and second raised portions 34, 36 and is shown being substantially flat in FIG. 2, but could be formed into other configurations as well.

Figure 3:
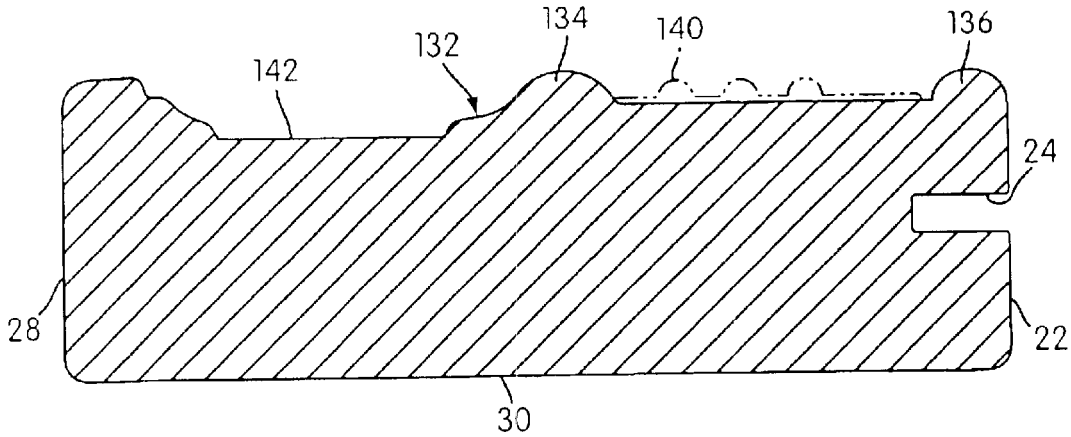
FIG. 3 is a cross sectional view similar to FIG. 2, but showing a variation of the top contoured surface shown in FIG. 2.

A raised decorative portion 40, which may be made from a composition material or compo, can be formed on a portion of the recessed portion 38. The composition material or compo can be a paste, a thermoplastic, a chalk, a resin, glue, linseed oil, other suitable materials that can be coupled to a door or any combination thereof, for example, but is not limited to such materials. The raised decorative portion 40, together with the contoured top surface 32, can be formed to include many different aesthetic intricacies, and can be finished with paint, foil or wrapped in paper, for example. In FIG. 2, the raised decorative portion 40 is formed into an ornamental pattern. Other examples of different aesthetic intricacies may include other ornamental patterns, as shown in FIGS. 3 and 4.

Due to such intricacies and finishes, a height h3 of the raised decorative portion 40 may vary across the recessed portion 38. Thus, the height h3 is representative of the height of the highest part of the raised decorative portion 40. The raised decorative portion 40 is formed on the recessed portion 38 so that the height h3 of the raised decorative portion 40 is less than the respective heights h1, h2 of the first and second raised portions 34, 36. By extending higher than the raised decorative portion 40, the first and second raised portions 34, 36 can protect the raised decorative portion 40 from contact with various blunt sources, which can damage or destroy the decorative raised portion 40. Also, because the first and second raised portions 34, 36 have a brittleness that is less than a brittleness of the raised decorative portion 40, the first and second raised portions 34, 36 can protect the raised decorative portion 40 from contact with various sources. Such sources of contact can include boots or shoes, toys, tools or vacuum cleaners, for example.

As briefly discussed above, FIG. 3 shows a raised decorative portion 140 formed into another ornamental pattern. The raised decorative portion 40 and the contoured top surface 32, as shown in FIG. 2, are slightly modified as a raised decorative portion 140 and a contoured top surface 132 to form the ornamental pattern shown in FIG. 3. Also, a first raised portion 134 is formed in a mid-portion of the contoured top surface 132 and a second raised portion 136 extends from the inner surface 22. The contoured top surface 132 also includes a second recess portion 142 extending between the outer surface 28 and the first raised portion 136. The height of the raised decorative portion 140 is less than the respective heights of the first and second raised portions 134, 136. By extending higher than the raised decorative portion 140, the first and second raised portions 134, 136 can protect the raised decorative portion 140 from contact with various sources, which can damage or destroy the decorative raised portion 140.

Figure 4:
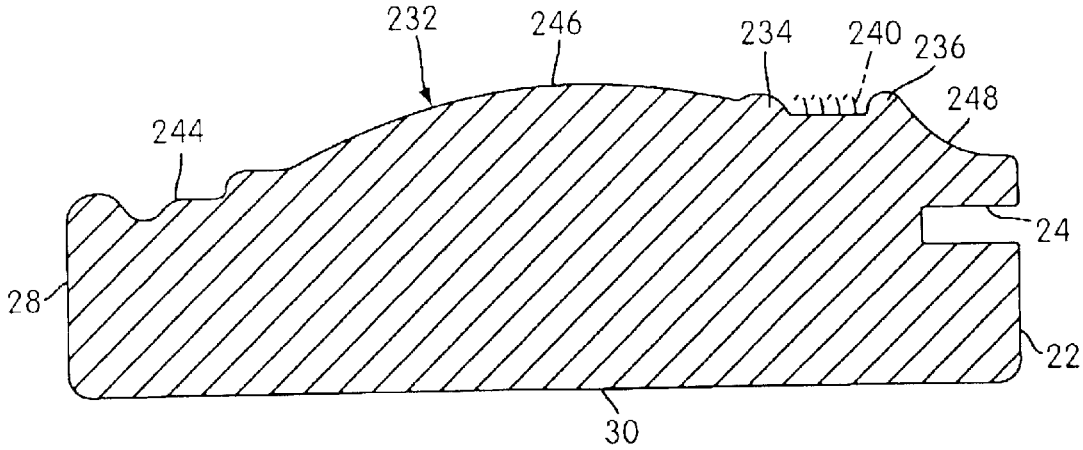
FIG. 4 is a cross sectional view similar to FIG. 3, but showing a variation of the top contoured surface shown in FIG. 3.

FIG. 4 shows a raised decorative portion 240 formed into yet another ornamental pattern. The raised decorative portion 140 and the contoured top surface 132, as shown in FIG. 3, are slightly modified as a raised decorative portion 240 and a contoured top surface 232 to form the ornamental pattern shown in FIG. 4. The contoured top surface 232 includes a recessed portion 244 extending from the outer surface 28 and an arcuate portion 246 extending from the recessed portion 244. A first raised portion 234 extends from the arcuate portion 246 of the contoured top surface 232 and a second raised portion 236 extends from a concave portion 248 of the top surface 232, which extends from the inner surface 22. The height of the raised decorative portion 240 is less than the respective heights of the first and second raised portions 234, 236. By extending higher than the raised decorative portion 240, the first and second raised portions 234, 236 can protect the raised decorative portion 240 from contact with various sources, which can damage or destroy the decorative raised portion 240.

Figure 5:
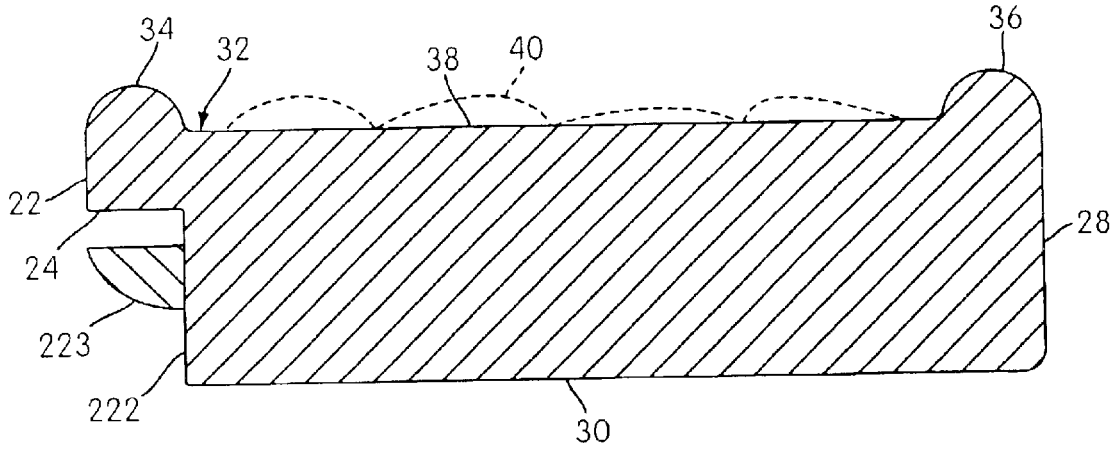
FIG. 5 is a cross sectional view similar to FIG. 2, but showing a variation of a peripheral interior surface of the frame panel shown in FIG. 2.

The ornamental patterns shown in FIGS. 2, 3 and 4 are only examples and other ornamental patterns could be used without departing from the principles of the invention. Also, the top panel 16, the bottom panel 18 or at least one of the side panels 20 can be modified without departing from the principles of the invention. For example, FIG. 5 shows an ornamental pattern similar to that shown in FIG. 2, but showing one of the top panel 16, the bottom panel 18 and the side panels 20 including a stop member 223 positioned on a rabbett portion 222 of the interior surface 22. The interior surface 22 is shown as having the rabbett portion 222 and the stop member 223 can be fastened to the rabbett portion 222 to form the groove 24. The stop member 223 can be positioned in the rabbett portion 222 to form a groove of any size so to accommodate interior panels 14 of different sizes to be placed in the groove 24, for example. The stop member 223 may be fastened to the rabbett portion 222 with fasteners, such as nails, screws, or nuts and bolts, or may be adhered or bonded thereto with adhesives or bonding materials, for example.

Figure 6:
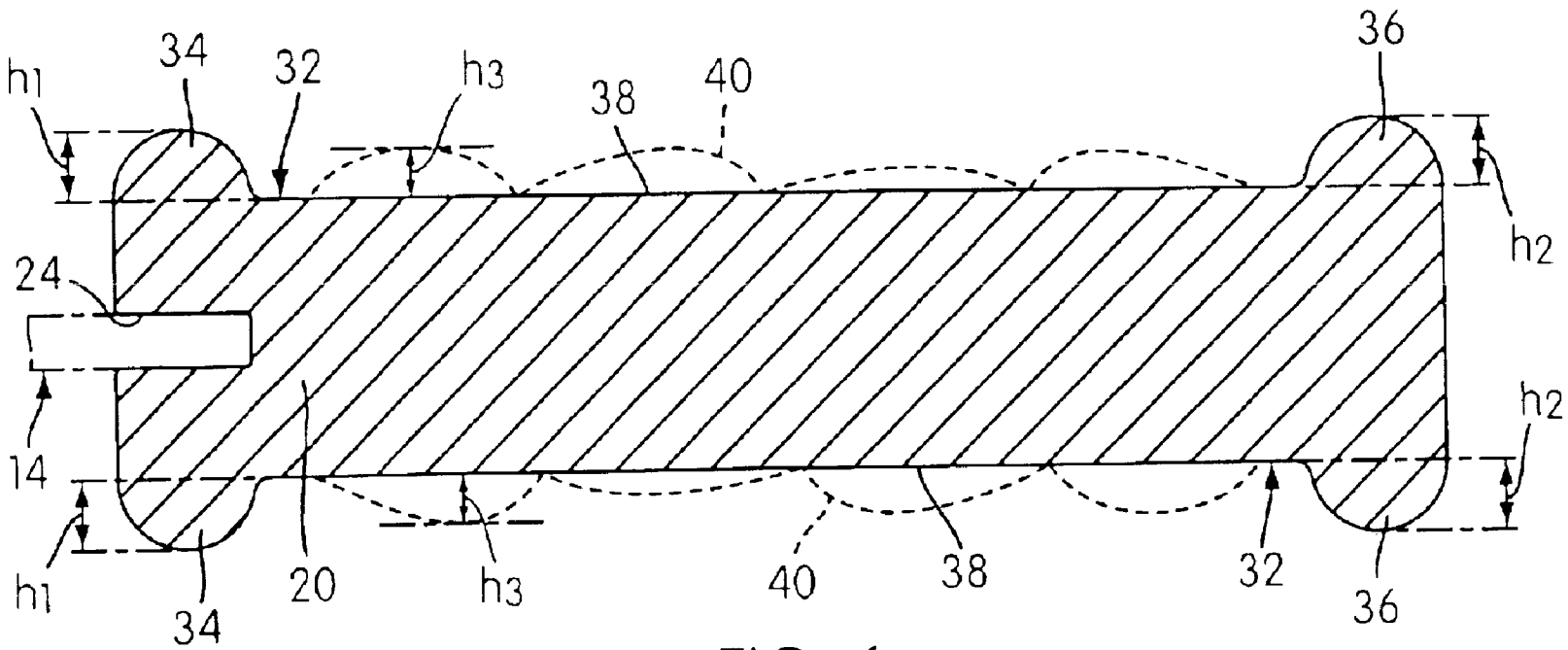
FIG. 6 is a cross sectional view similar to FIG. 2, but showing a variation of an inside surface of the frame panel shown in FIG. 2.

FIG. 6 shows an ornamental pattern similar to that shown in FIG. 2, but showing one of the side panels 20 including the ornamental pattern on both sides thereof. For example, the top contoured surface 32 of the side panel 20 in FIG. 2 is duplicated to replace the inside surface of the side panel 20 in FIG. 6. This configuration could be provided on any one of the top panel 16, the bottom panel 18 and the other side panel 20, for example.

Figure 7:
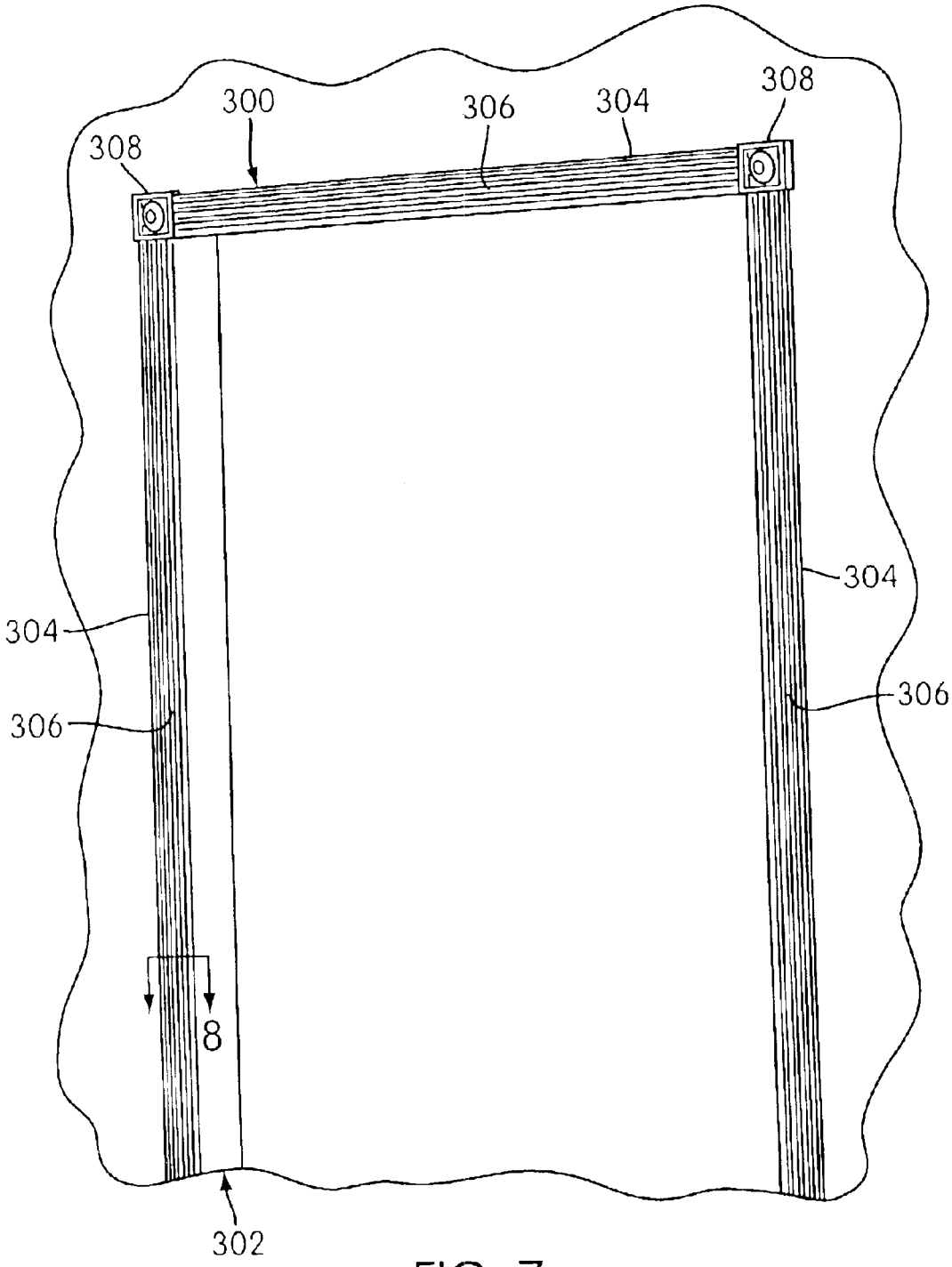
FIG. 7 is a perspective view of a decorative molding in accordance with the principles of the present invention.

FIG. 7 shows a variation of the decorative molding 11 shown in FIG. 1 which is configured to compliment interior moldings and decoration. For example, a decorative molding 300, as shown in FIG. 7, is positioned to substantially surround or frame a doorway 302, for example. The molding 300 comprises an elongated panel 304 having a contoured top surface 306 on each of the top, left and right sides of the doorway 302. Corner pieces 308 may be provided to connect the moldings 300 on each of the top, left and right sides of the doorway 302. It is contemplated that the decorative molding 300 can be positioned in different areas of a residential or commercial structure, such as, in an interior doorway, a patio door opening, a doorway between rooms, or a closet doorway, for example.

Figure 8:
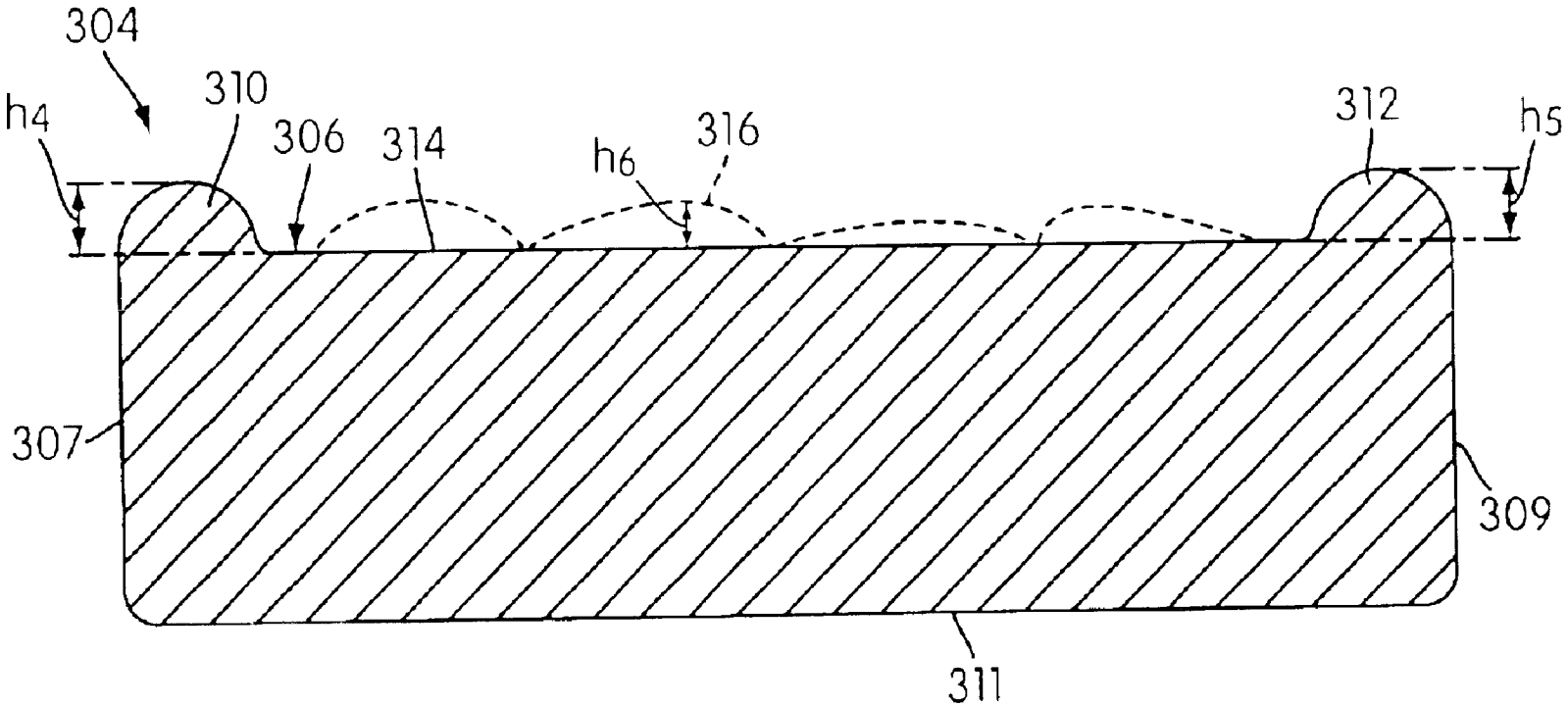
FIG. 8 is a cross sectional view taken along the line 8—8 in FIG. 7 showing an elongated panel having a top contoured surface of the decorative molding.

FIG. 8 shows a cross sectional view of one of the elongated panels 304. The panels 304 include substantially flat inner and outer surfaces 307, 309 and a bottom surface 311. The bottom surface 311 is substantially flat and is configured to be placed against a substantially flat wall or doorway, for example.

As best seen in FIG. 8, the contoured top surface 306 has at least a first raised portion 310 extending along the top surface 306 in a longitudinal direction. A second raised portion 312 extends along the top surface 306 in a generally parallel and spaced relation to the first raised portion 310. The first and second raised portions 310, 312 have a predetermined height, as represented by h4 and h5, respectively, and form a recessed portion 314 therebetween. A raised decorative portion 316 is formed on at least a portion of the recessed portion 314 and has a height, as represented by h6, that is less than the predetermined heights h4 and h5.

By extending higher than the raised decorative portion 316, the first and second raised portions 310, 312 can protect the raised decorative portion 316 from contact with various sources, which can damage or destroy the decorative raised portion 316. Also, because the first and second raised portions 310, 312 have a brittleness that is less than a brittleness of the raised decorative portion 316, the first and second raised portions 310, 312 can protect the raised decorative portion 316 from contact with various sources. Such sources of contact can include boots or shoes, toys, tools or vacuum cleaners, for example.

Figure 9:
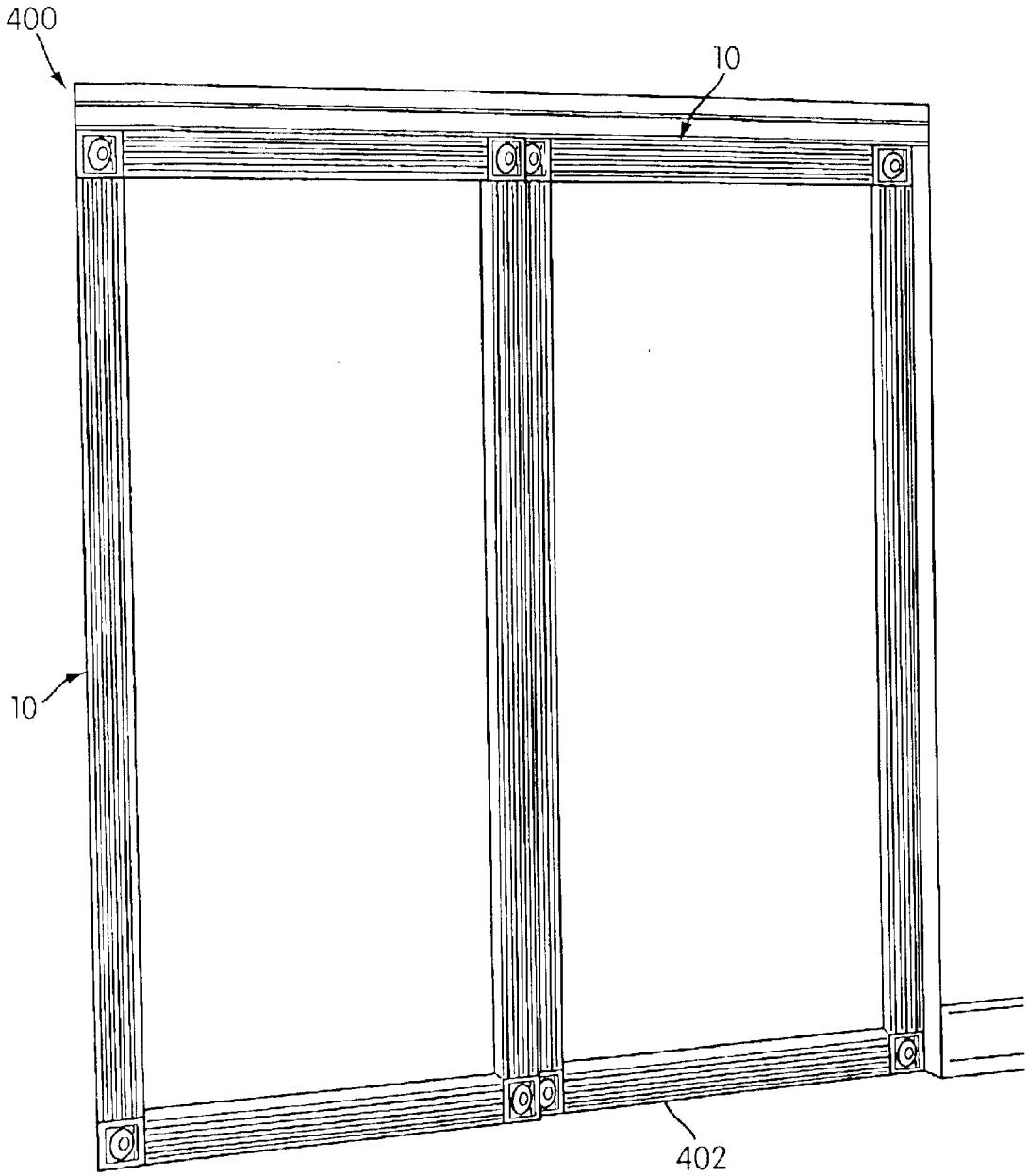
FIG. 9 is a perspective view of another embodiment of a decorative door in accordance with the principles of the present invention.

The moldings 11, 300 as illustrated in FIGS. 1 and 7 may at least partially frame a door or doors, such as the doors 10, or other door variations, for example. Similarly, the door 10 can be used in other door variations as well. For example, FIG. 9 shows a sliding door 400 constructed such that one door 10 slides in front of or in back of another adjacent door 10. Upper or lower tracks 402 may be provided on which the doors 10 slide or roll using wheels mounted on the doors, for example.

Figure 10:
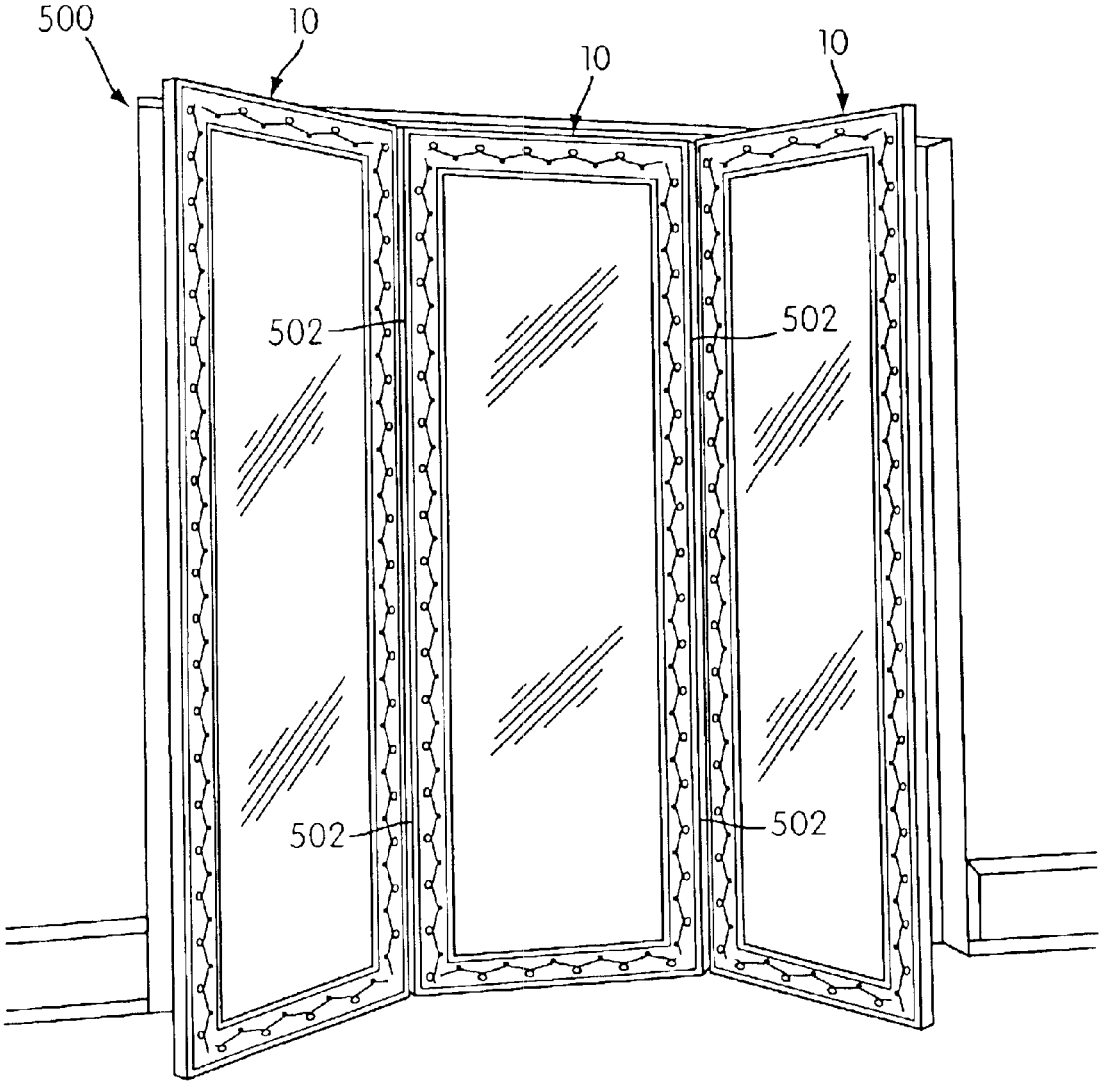
FIG. 10 is a perspective view of yet another embodiment of a decorative door in accordance with the principles of the present invention.

FIG. 10 shows a tri-fold door assembly 500 constructed such that three adjacent doors 10 are connected to one another with a plurality of hinges 502. The hinges 502 allow adjacent doors 10 to move relative to one another by folding, for example. The doors 10 may be free standing, as shown in FIG. 10, or may be provided with a support assembly (not shown) to support the doors 10 in an upright position. Three doors 10 are illustrated in FIG. 10, but any number of adjacent doors, for example, 2, 4, 5 or more adjacent doors, can be connected to one another with fasteners, such as hinges 502, at adjacent sides thereof.

Figure 11:
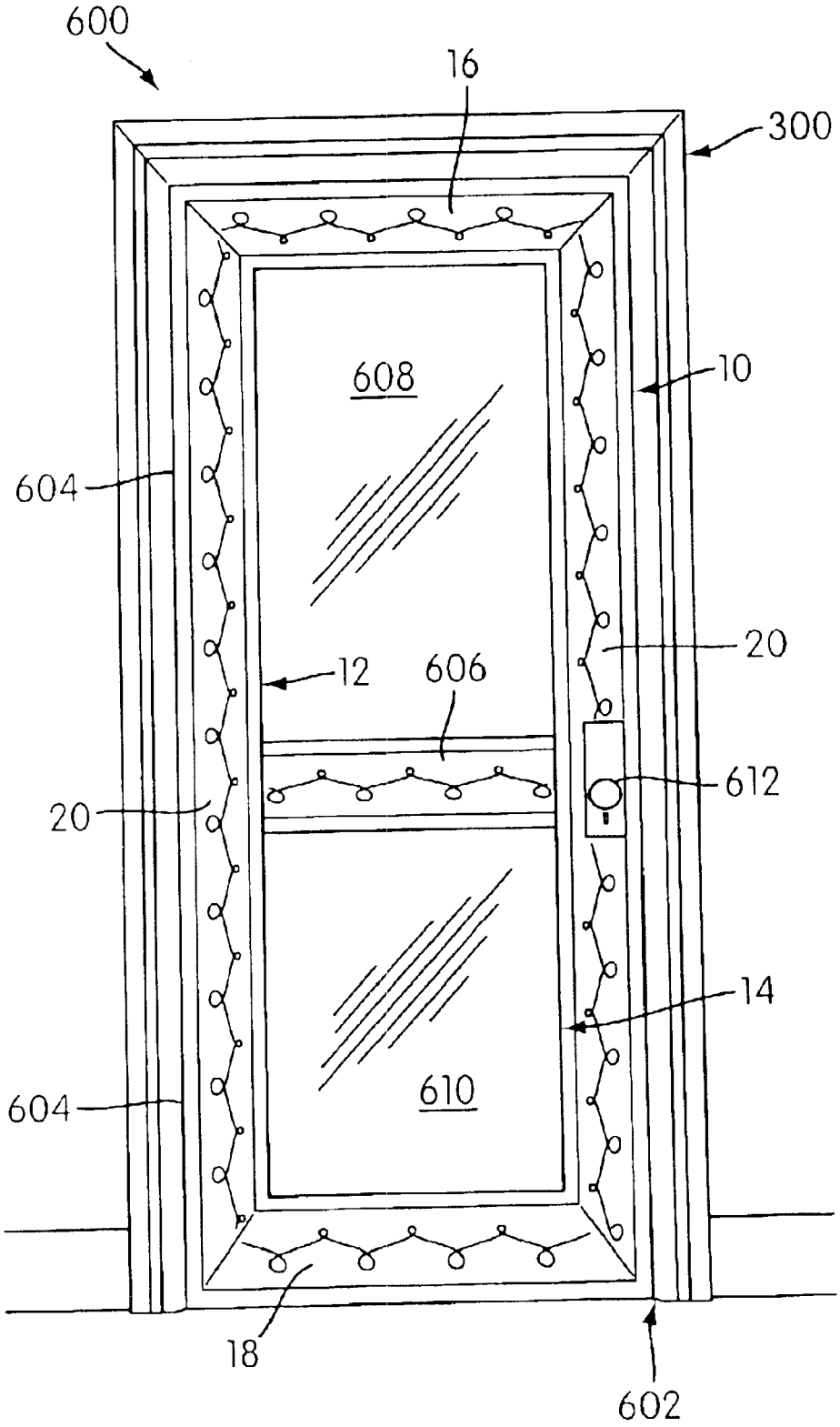
FIG. 11 is a perspective view of still another embodiment of a decorative door in accordance with the principles of the present invention.

FIG. 11 shows a hinged door assembly 600 constructed such that one door 10 is connected to a doorway 602 with a plurality of hinges 604. The hinged door assembly 600 is framed with a molding, such as the molding 300, for example. The hinges 604 allow the door 10 to pivot relative to the doorway 602 and may be positioned on either the door 10 or the doorway 602 for aesthetic appeal. The door frame 12 is shown being divided by a cross-panel 606. The cross-panel 606 has substantially the same construction as the top, bottom and side panels 16, 18, 20 and may divide the interior panel 14 into an upper section 608 and a lower section 610, for example. A handle 612 can be provided on the door 10 to facilitate opening and closing thereof. Although only one door 10 is shown, more than one door 10 can be connected to a doorway with hinges to pivot relative to the doorway.

Figure 12:
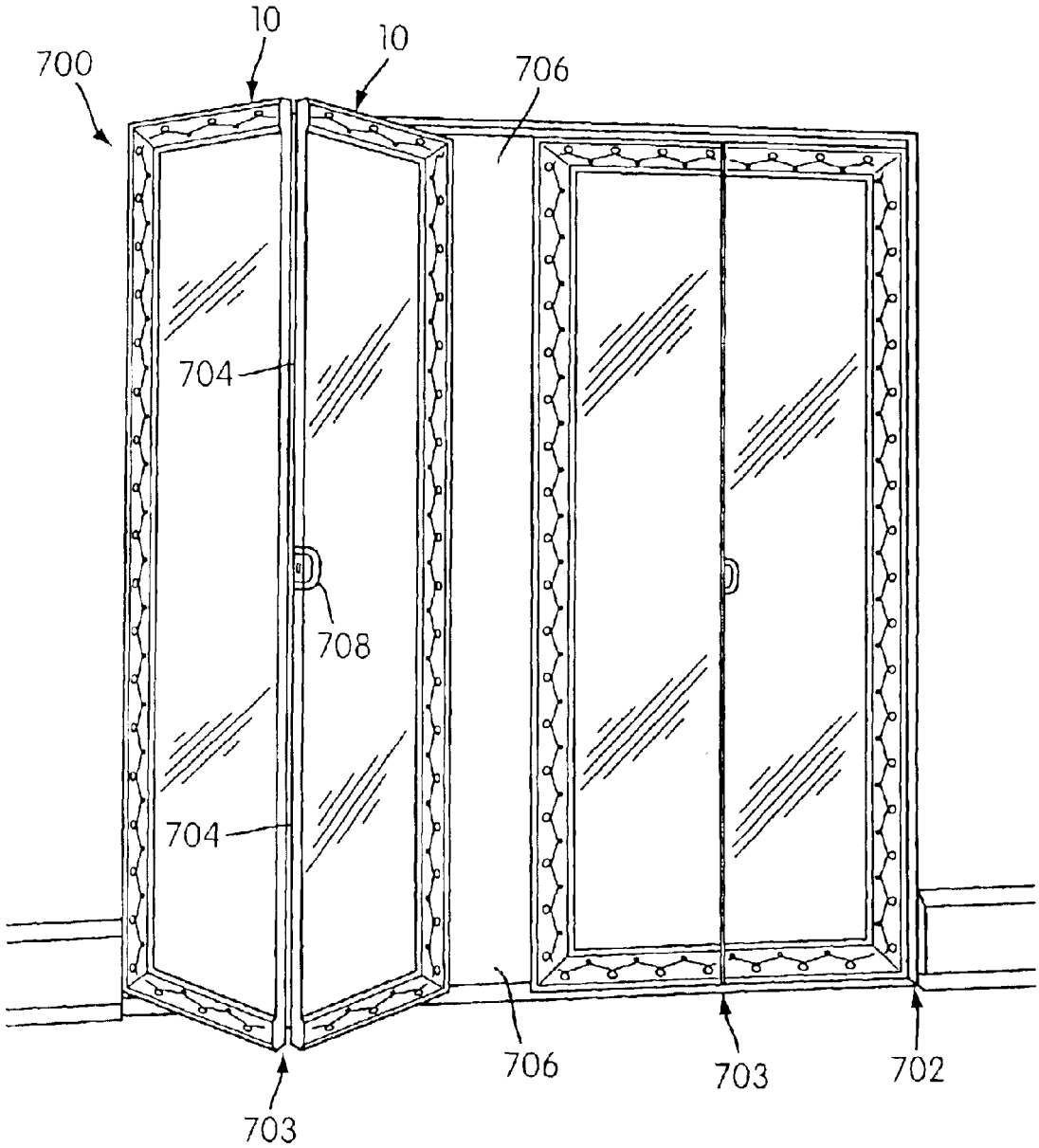
FIG. 12 is a perspective view of yet another embodiment of a decorative door in accordance with the principles of the present invention.

FIG. 12 shows a bi-fold sliding door assembly 700 positioned in a doorway 702. The bi-fold sliding door assembly 700 is constructed such that a pair of bi-fold door members 703 each include a plurality of doors 10 connected to one another with a plurality of hinges 704. The hinges 704 allow adjacent doors 10 to move relative to one another by folding, for example. Upper or lower tracks 706 may be provided in the doorway 702 so that the door members 703 and the doors 10 can slide or roll relative to one another, for example, using wheels mounted on the doors. A handle 708 can be provided on one of the doors 10 of each door member 703 to facilitate opening and closing thereof.

Each of the doors 10, as illustrated in the above examples, includes a decorative portion that includes a composition material configured to provide an ornamental design on the door, for example, on the frame 12 of the door 10.

It will be appreciated that numerous modifications to and departures from the preferred embodiments described above will occur to those having skill in the art. Thus, it is intended that the present invention covers the modifications and variations of the invention, provided they come within the scope of the appended claims and their equivalents.

What is claimed is:

1. A decorative molding comprising:

an elongated panel having a contoured top surface having at least a first raised portion extending along the top surface in a longitudinal direction and a second raised portion extending along the top surface in spaced relation to the first raised portion, wherein the first raised portion and the second raised portion have a first predetermined height and a second predetermined height, wherein the first raised portion and the second raised portion from a recessed portion wherein the elongated panel has a side having a slot formed therein adapted to receive an interior panel therein; and a raised decorative portion formed directly on at least a portion of the recessed portion, wherein the raised decorative portion has a height, wherein the height is less than the smaller of the first and second predetermined heights, wherein a brittleness of the first and second raised portions is less than a brittleness of the raised decorative portion.

2. The decorative molding according to claim 1, wherein the raised decorative portion is formed from a composition material.

3. The decorative molding according to claim 2, wherein the composition material is at least one of a paste and a thermoplastic material.

4. A decorative door comprising:

a frame having a top panel, a bottom panel and a pair of side panels, wherein the top panel is connected to each of the side panels and the bottom panel is connected to the side panels, wherein each of the top panel, the bottom panel and the pair of side panels has an interior side having a slot formed therein, wherein the panels form a generally rectangular frame; and an interior panel connected to each of the top panel, the bottom panel and the pair of side panels, wherein the interior panel is received within the slot formed in the interior side of the top panel, the bottom panel and the pair of side panels wherein at least one of the top panel, the bottom panel and the pair of side panels has a contoured top surface having a length, at least a fast raised portion extending along the length of the contoured top surface and a second raised portion extending along the length of the contoured top surface in spaced relation to the first raised portion, wherein the first raised portion and the second raised portion have a fist predetermined height and a second predetermined height, wherein the first raised portion and the second raised portion form a recessed portion therebetween and a raised decorative portion formed directly on at least a portion of the recessed portion, wherein the raised decorative portion having a height, wherein the height is less than the smaller of the first and second predetermined heights, wherein a brittleness of the first and second raised portions is less than a brittleness of the raised decorative portion.

5. The decorative door according to claim 4, wherein the interior panel includes a mirror.

6. The decorative door according to claim 4, wherein the raised decorative portion is formed from a composition material.

7. The decorative door according to claim 6, wherein the composition material is at least one of a paste and a thermoplastic material.

8. A decorative door comprising:

a frame having at least a first raised portion and a second raised portion extending in spaced relation to the first raised portion, wherein the first raised portion and the second raised portion have a first predetermined height and a second predetermined height, wherein the frame has an inner perimeter having a slot formed therein:

an interior panel connected to the frame, wherein the interior panel is received within the slot; and a decorative portion including a composition material configured to provide an ornamental design on the frame, the decorative portion having a height that is less than the smaller of the first and second predetermined heights, wherein the first and second raised portions are integrally formed with the frame and the decorative portion is separately coupled to the frame.

9. The decorative door according to claim 8, wherein the composition material is at least one of a paste and a thermoplastic material.

10. The decorative door according to claim 8, wherein the interior panel includes a mirror.

11. The decorative door according to claim 8, wherein the frame comprises a top panel, a bottom panel and a pair of side panels, wherein the top panel is connected to each of the side panels and the bottom panel is connected to the side panels, and wherein the panels form a generally rectangular frame, wherein each pair of the top panel, the bottom panel and the pair of side panels has an interior side which together form the inner perimeter and a slot formed therein for receiving the decorative panel.

12. The decorative door according to claim 11, wherein each of the top panel, the bottom panel and the pair of side panels includes an inner surface having a groove formed therein, wherein at least a portion of the interior panel is received with the groove.

13. A method of forming a decorative panel comprising:

forming a panel structure having at least a pair of raised portions having at least a first predetermined height;

applying a moldable material directly on the panel in an area between the pair of raised portions; and molding the moldable material on the panel to produce a decorative pattern, wherein the decorative pattern has height less than the first predetermined height.

* * * * *